US009371698B2

(12) United States Patent
Chung

(10) Patent No.: US 9,371,698 B2
(45) Date of Patent: Jun. 21, 2016

(54) SUBSURFACE FORMATION CUTTER

(71) Applicant: Bernard Compton Chung, Calgary (CA)

(72) Inventor: Bernard Compton Chung, Calgary (CA)

( * ) Notice: Subject to any disclaimer, the term of this patent is extended or adjusted under 35 U.S.C. 154(b) by 316 days.

(21) Appl. No.: 14/073,068

(22) Filed: Nov. 6, 2013

(65) Prior Publication Data

US 2015/0122550 A1 May 7, 2015

(51) Int. Cl.
*E21B 10/28* (2006.01)
*E21B 7/28* (2006.01)

(52) U.S. Cl.
CPC .. *E21B 10/28* (2013.01); *E21B 7/28* (2013.01)

(58) Field of Classification Search
CPC ..... E21B 10/28; E21B 7/28; E21B 10/32
See application file for complete search history.

(56) References Cited

U.S. PATENT DOCUMENTS

| | | | | |
|---|---|---|---|---|
| 1,406,351 | A | 2/1922 | Corrigan | |
| 2,178,553 | A | 11/1939 | Bowie | |
| 2,324,956 | A | 7/1943 | Sewell | |
| 2,698,733 | A | 1/1955 | Schlumberger | |
| 3,881,775 | A | 5/1975 | McPherson et al. | |
| 4,491,022 | A | 1/1985 | de la Cruz | |
| 6,024,166 | A | 2/2000 | McGarian et al. | |
| 6,595,301 | B1 | 7/2003 | Diamond et al. | |
| 6,722,452 | B1 | 4/2004 | Rial et al. | |
| 6,757,255 | B1 | 6/2004 | Aoki et al. | |
| 6,976,547 | B2 | 12/2005 | Rial et al. | |
| 7,222,682 | B2 * | 5/2007 | Doering | F16H 7/06 175/104 |
| 7,287,604 | B2 | 10/2007 | Aronstam et al. | |
| 7,401,666 | B2 | 7/2008 | Fanuel et al. | |
| 7,584,811 | B2 | 9/2009 | Fanuel et al. | |
| 7,802,637 | B2 | 9/2010 | Aronstam et al. | |
| 7,931,098 | B2 | 4/2011 | Aronstam et al. | |
| 7,975,783 | B2 | 7/2011 | Fanuel et al. | |
| 2005/0067166 | A1 * | 3/2005 | Trueman | E21B 7/061 166/313 |
| 2011/0209872 | A1 * | 9/2011 | McAfee | E21B 29/005 166/298 |
| 2012/0085529 | A1 | 4/2012 | Tunney et al. | |

FOREIGN PATENT DOCUMENTS

| | | | |
|---|---|---|---|
| CA | 2568909 | C | 12/2005 |
| GB | 842549 | A | 7/1960 |
| WO | 96/04457 | A1 | 2/1996 |

* cited by examiner

*Primary Examiner* — Brad Harcourt
(74) *Attorney, Agent, or Firm* — David A. Guerra

(57) ABSTRACT

The present invention is a subsurface formation cutter for directional cutting into a subterranean formation. The subsurface formation cutter includes a transmission unit, a cutter bit, a bit brace, and a ram unit. The transmission unit has a driver shaft operatively connected to a bottom hole assembly. The cutter bit has a connector member, a cutter body rotatably coupled to the connector member, and a bit shaft connected to the cutter body. The bit shaft is operatively coupled to the driver shaft of the transmission unit. The ram unit has a moveable ram shaft connected to a traveling member. The bit brace is pivotably connected to the connector member and the traveling member. A connection member is attaches the ram unit to the transmission unit, and is configured to receive and guide the traveling member to travel in a direction parallel with a longitudinal axis of the subsurface formation cutter.

27 Claims, 13 Drawing Sheets

SUBSURFACE FORMATION CUTTER

BACKGROUND OF THE INVENTION

1. Field of the Invention

The present invention relates to a subsurface formation cutter for use in connection with directional cutting into a subterranean formation.

2. Description of the Prior Art

The use of formation cutting devices is known in the prior art, and various technologies exist for recovering hydrocarbon fluids from subterranean formations. It is known to one skilled in the art that hydrocarbon fluids can be collected from a production wellbore which is positioned in a formation that contains hydrocarbon fluids. The movement of hydrocarbon fluids to the production wellbore may be driven by a multiplicity of forces, including the wellbore internal pressure, external pressurization of the formation, fluid injection drive, a combustion front (i.e., in situ combustion), and steam assisted gravity drainage (SAGD), etc.

It can be appreciated that many factors contribute to or impede the flow of hydrocarbon fluids to the production wellbore or the injection of fluid into the reservoir, such as but not limited to, the magnitude of the driving forces in the formation, the viscosity of the hydrocarbon fluids in and through the formation and the permeability of the formation especially near the wellbore. These factors contribute to the production rate of the hydrocarbon fluids and its enhanced recovery for increasing the amount of hydrocarbon fluids that can be extracted from a formation.

The volumetric sweep efficiency at any time is the fraction of the total reservoir volume contacted and removed by the driving forces during the recovery. Consideration of the mobility of the fluids is an important factor when determining the area and vertical sweep efficiency components of the volumetric sweep efficiency. The mobility of hydrocarbon fluids in a subterranean formation is the ratio of the permeability of the formation to the viscosity of the hydrocarbon fluids. Mobility is therefore a function of both the properties of the hydrocarbon fluids and the properties of the subterranean formation. As the mobility ratio varies along the wellbore, the production rate or injection rate and the sweep efficiency vary accordingly.

For a given magnitude of driving force, the flow of hydrocarbon fluids to the production wellbore may generally be expected to increase as the mobility of the hydrocarbon fluids in the formation increases, either by decreasing the viscosity of the hydrocarbon fluids or by increasing the permeability of the formation.

Known methods for decreasing the viscosity of hydrocarbon fluids in a subterranean formation include increasing the temperature of the hydrocarbon fluids in the formation and/or diluting the hydrocarbon fluids in the formation with a less viscous fluid.

SAGD process that injects steam into the formation is currently used to increase the temperature of the hydrocarbon fluids in the formation and decrease its viscosity. Additional methods of increasing the temperature of the hydrocarbon fluids are by introducing a heat source into the formation, by in-situ combustion of the formation, or the like. Diluting the hydrocarbon fluids in the formation may be achieved by injecting a diluent fluid such as a light hydrocarbon fluid or carbon dioxide into the formation. It also known to decrease the viscosity of the hydrocarbon fluids in the formation by increasing the temperature of the hydrocarbon fluids and in combination with diluting the hydrocarbon fluids.

While the above-described devices fulfill their respective, particular objectives and requirements, the aforementioned patents do not describe a subsurface formation cutter that allows directional cutting into a subterranean formation where flow into the well is locally impeded or blocked by poor permeability in the reservoir or by formation damage during drilling.

Therefore, a need exists for a new and improved subsurface formation cutter that can be used for directional cutting into a subterranean formation to selectively improve the flow into the well from the reservoir, thereby, resulting in increases in production rate, well bore conformance, volumetric sweep efficiency and recovery of reservoir fluid. Technically, the cut channel effectively creates a stimulation affect on the well causing it to produce or inject more fluids either as a larger wellbore or as a wellbore with beneficial negative skin. In this regard, the present invention substantially fulfills these and other needs. The cut can be used to direct and control subsequent fracturing of the formation or as a replacement for hydraulic fracturing. In this respect, the subsurface formation cutter according to the present invention substantially departs from the conventional concepts and designs of the prior art, and in doing so provide an apparatus primarily developed for the purpose of directional cutting into a subterranean formation.

SUMMARY OF THE INVENTION

In view of the foregoing disadvantages inherent in the known types of formation cutting devices now present in the prior art, the present invention provides an improved subsurface formation cutter, and overcomes the above-mentioned disadvantages and drawbacks of the prior art. As such, the general purpose of the present invention, which will be described subsequently in greater detail, is to provide a new and improved subsurface formation cutter and method which has all the advantages of the prior art mentioned heretofore and many novel features that result in a subsurface formation cutter which is not anticipated, rendered obvious, suggested, or even implied by the prior art, either alone or in any combination thereof.

To attain this, the present invention essentially comprises a subsurface formation cutter for directional cutting into a subterranean formation. The subsurface formation cutter has a fluid and torque transmission (FTT) unit, a cutter bit, a bit brace, a ram unit and a connection member. The transmission unit has a housing, and a driver shaft operatively coupled to a motor of a bottom hole assembly. The cutter bit has a connector member, a cutter body rotatably coupled to the connector member, and a bit shaft connected to the cutter body. The bit shaft is operatively coupled to the driver shaft of the transmission unit to rotate the cutter body. The cutter bit may be pivotably associated with the transmission unit. The bit brace has a first end pivotably connected to the connector member of the cutter bit, and a second end. The ram unit has a moveable ram shaft connected to a traveling member. The traveling member is pivotably connected to the second end of the bit brace. The connection member is attached to the transmission unit and the ram unit. The connection member is configured to receive and guide the traveling member to travel in a direction parallel with a longitudinal axis of the subsurface formation cutter.

In some embodiments, the transmission unit may be further comprised of at least one driver gear attached to the driver shaft, and the cutter bit may be comprised of a bit gear operatively coupled to the driver gear.

There has thus been outlined, rather broadly, the more important features of the invention in order that the detailed description thereof that follows may be better understood and in order that the present contribution to the art may be better appreciated.

The invention may also include a friction block associated with the connection member and configured to removably retain the traveling member at a predetermined location along the connection member. There are, of course, additional features of the invention that will be described hereinafter and which will form the subject matter of the claims attached.

In some embodiments, the cutter body may be further comprised of at least one bit passage defined along at least a portion of a longitudinal axis of the cutter body, and at least one outlet port defined through the cutter body and in fluid communication with the bit passage. The bit passage may be in fluid communication with the transmission unit.

In some embodiments, the bit gear may be further comprised of a bit gear passage defined therethrough and in fluid communication with the bit passage and with an interior of the transmission unit. The bit shaft may be further comprised of a bit shaft passage defined therethrough and in fluid communication with the interior of the transmission unit.

In some embodiments, the cutter bit may be further comprised of a flexible fluid line in fluid communication with the bit passage and the transmission unit.

In some embodiments, the cutter bit may be further comprised of a connector member passage defined in a portion of the connector member. The connector member passage may be in fluid communication with the bit passage and the flexible fluid line.

In some embodiments, the transmission unit may be further comprised of at least one intermediate gear operatively coupled between the driver gear and the bit gear In some embodiments, the transmission unit may be further comprised of a cover configured to rotatably receive the bit shaft of the cutter bit therethrough, and a slot defined through a portion of the housing. The slot may be configured to receive the bit shaft of the cutter bit therethrough.

In some embodiments, the traveling member may be associated with a pin that is received in at least one slot defined in a portion of the connection member.

In some embodiments, a fluid line may be in fluid communication with the transmission unit and the ram unit. The fluid line may be configured to provide a fluid from the transmission unit to the ram unit to move the ram shaft.

In some embodiments, the cutter bit may be further comprised of a flexible shaft attached between the bit shaft and the cutter body.

In some embodiments, the bit shaft may be further comprised of a first bit shaft connected to the bit gear, and a second bit shaft connected to the cutter body. The first and second bit shafts may be operatively coupled to each other by a universal joint.

In some embodiments, the driver and bit shafts may be operatively coupled to each other by a universal joint.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved subsurface formation cutter that has more than all of the advantages of the prior art formation cutting devices and none of the disadvantages.

It is another object of the present invention to provide a new and improved subsurface formation cutter that may be easily and efficiently manufactured and marketed.

An even further object of the present invention is to provide a new and improved subsurface formation cutter that has a low cost of manufacture with regard to both materials and labor, and which accordingly is then susceptible of low prices of sale to the consuming public, thereby making such subsurface formation cutter economically available to the buying public.

Still another object of the present invention is to provide a new subsurface formation cutter that provides in the apparatuses and methods of the prior art some of the advantages thereof, while simultaneously overcoming some of the disadvantages normally associated therewith.

Even still another object of the present invention is to provide a subsurface formation cutter for directional cutting into a subterranean formation. This allows for directional cutting into a subterranean formation by coupling the subsurface formation cutter to a standard bottom hole assembly or mud motor. The directional cutting may be performed by using standard drilling mud to operate a downhole motor, which in turn will drive a pivotable rotating cutter bit. A portion of the drilling mud may be diverted to a ram unit which will operate a ram shaft, which in turn will force a pivotable bit brace, and the pivotable cutter bit to buckle so that the cutter bit pivots outwardly into the formation. The subsurface formation cutter is then pulled so that the cutter bit advances toward and into the formation, thereby cutting a predetermined area into the formation.

Lastly, it is an object of the present invention to provide a new and improved method of using the subsurface formation cutter to form a directional cut into a subterranean formation by advancing the subsurface formation cutter, in a retracted configuration, through a wellbore to a predetermined location in the formation. Then pumping a drilling mud down a drill string to operate a bottom hole assembly, including a motor which rotates the cutter bit. Diverting a portion of the mud to the ram unit and to the cutter bit. Operating the ram unit to move the ram shaft which will pivot the rotating cutter bit into the formation by way of a pivotably connected bit brace, thereby putting the subsurface formation cutter in a deployed configuration. The directional cut in the formation is then formed by pulling the subsurface formation cutter so that the rotating cutter bit advances toward and into the formation.

To retrieve the subsurface formation cutter from the wellbore, the pumping of the drilling mud is stopped, thereby allowing the cutter bit, the bit brace and the ram shaft to return to their original retracted configuration. The retracted subsurface formation cutter can then be pulled through the wellbore.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof, with phantom lines depicting environmental structure and forming no part of the claimed invention. Such description makes reference to the annexed drawings wherein:

The same reference numerals refer to the same parts throughout the various figures.

DETAILED DESCRIPTION OF THE INVENTION

Figure 1:
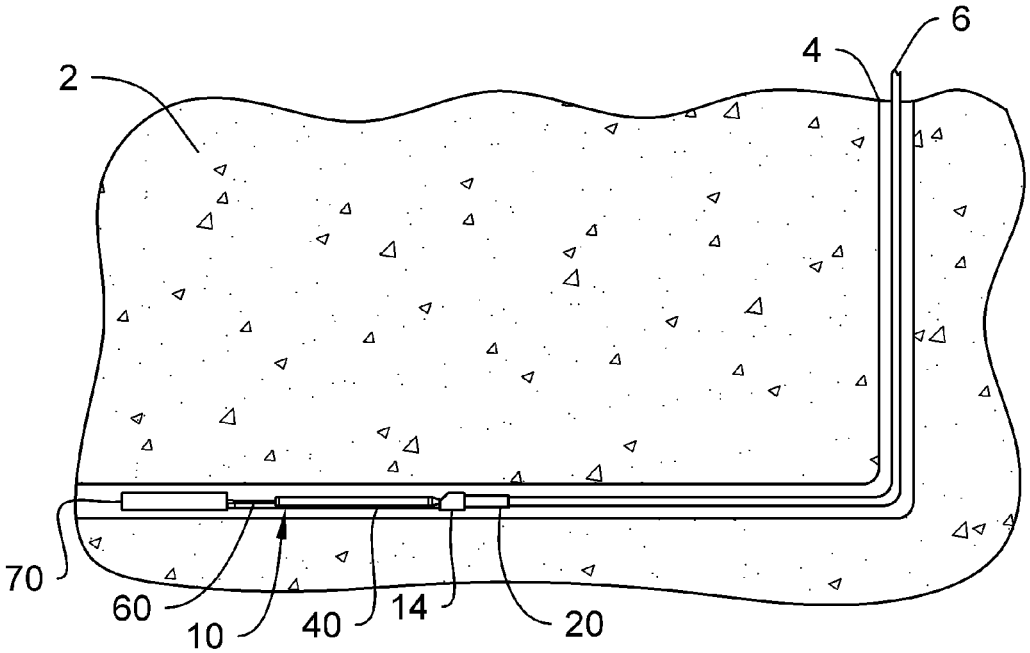
FIG. 1 is a schematic side view of an embodiment of the subsurface formation cutter advancing through a wellbore in a retracted configuration constructed in accordance with the principles of the present invention.

Referring now to the drawings and particularly to FIGS. 1-32, an embodiment of the subsurface formation cutter of the present invention is shown and generally designated by the reference numeral 10.

In FIG. 1, a new and improved subsurface formation cutter 10 of the present invention for directional cutting into a subterranean formation 2 is illustrated and will be described. The subsurface formation cutter 10 may be connected to a bottom hole assembly 20 that is connected to a drill string 6. The subsurface formation cutter 10 is able to be in a retracted configuration and a deployed configuration. While in the retracted configuration, the subsurface formation cutter 10 may be inserted and advanced through a wellbore 4 to position the subsurface formation cutter 10 at a predetermined location in the formation 2. The drill string 6 can provide fluid, hydraulic, electrical or communications to the subsurface formation cutter 10, and also provides a mechanical drive force to advance and retrieve the subsurface formation cutter 10 from the wellbore 4. The bottom hole assembly 20 can include a mud motor, a measurement while drilling (MWD) tool, or telemetry systems.

Figure 2:
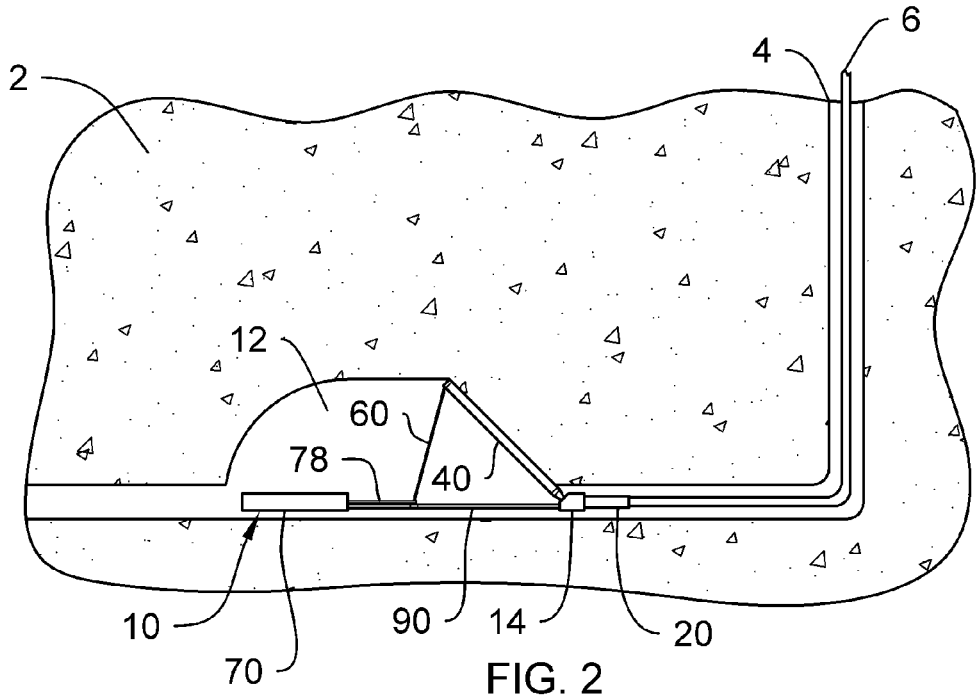
FIG. 2 is a schematic side view of the subsurface formation cutter of the present invention in a deployed configuration and demonstrating a formation cut.
Figure 3:
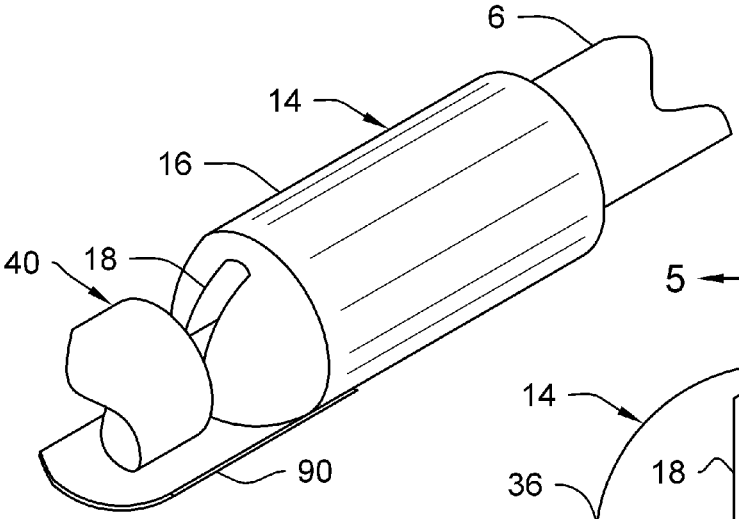
FIG. 3 is a perspective view of the FTT unit of the subsurface formation cutter of the present invention.

The subsurface formation cutter 10 is advanced through the wellbore 4 until its location is adjacent to or in the vicinity of a predetermined area of the formation 2, and then operated to the deployed configuration, as best illustrated in FIG. 2. The wellbore 4 can be, but not limited to, a vertical, horizontal or inclined wellbore. For exemplary purposes, the present application illustrates the subsurface formation cutter 10 in a horizontal wellbore 4.

More particularly, the subsurface formation cutter 10 has a fluid and torque transmission (FTT) unit 14 that drives and pivotably supports at least one cutter bit 40, at least one bit brace 60 that deploys and supports the cutter bit 40, and at least one ram unit 70 that drives the bit brace 60. When operated, the cutter bit 40 is activated and is pivoted into the formation 2 by linear movement of the bit brace 60 that is driven by the ram unit 70. After the cutter bit 40 is deployed into the formation, the subsurface formation cutter 10 can be pulled in a direction opposite of advancement, thereby cutting an enlarged area, furrow or channel 12 into the formation 2. It can be appreciated the subsurface formation cutter 10 may be rotated about a longitudinal axis of the wellbore to create radial cuts in the formation 2.

The FTT unit 14, as best illustrated in FIGS. 3-7, is operable connected to a mud or fluid motor of the bottom hole assembly 20 via an adapter 22. The bottom hole assembly 20 is operatively connected to the drill string 6. The FTT unit 14 includes an outer housing 16 with an end that defines a slot 18 adapted to allow a portion of the cutter bit 40 to extend therethrough. A connection member 90 may also be attached to the outer housing 16, the adapter 22 or the drill string 6. The end of the outer housing 16 that defines the slot 18 may be, but not limited to, tapered, conical, arcuate, planar or hemispherical, with the slot 18 following the profile of the end of the housing 16. The outer housing 16 may be cylindrical to assist in its travel through the wellbore.

Figure 5:
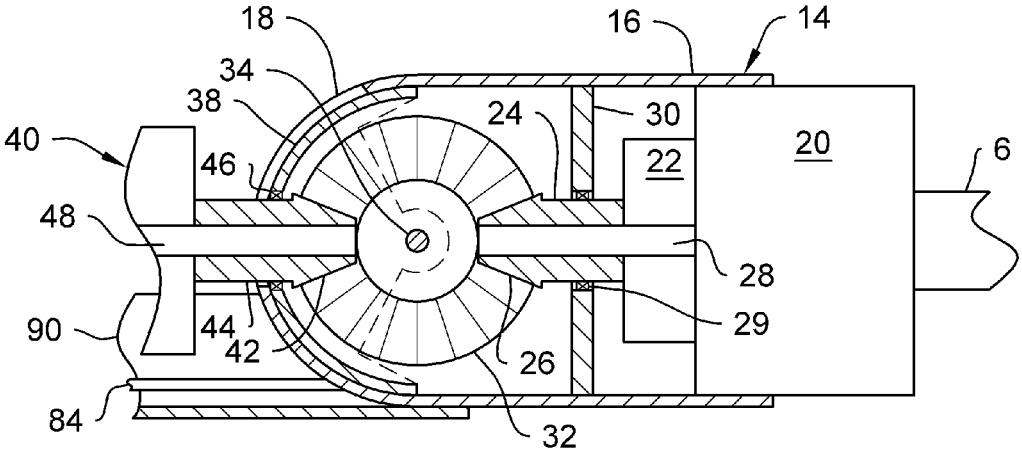
FIG. 5 is a cross-sectional view of the FTT unit in the retracted configuration taken along line 5-5 in FIG. 4.
Figure 6:
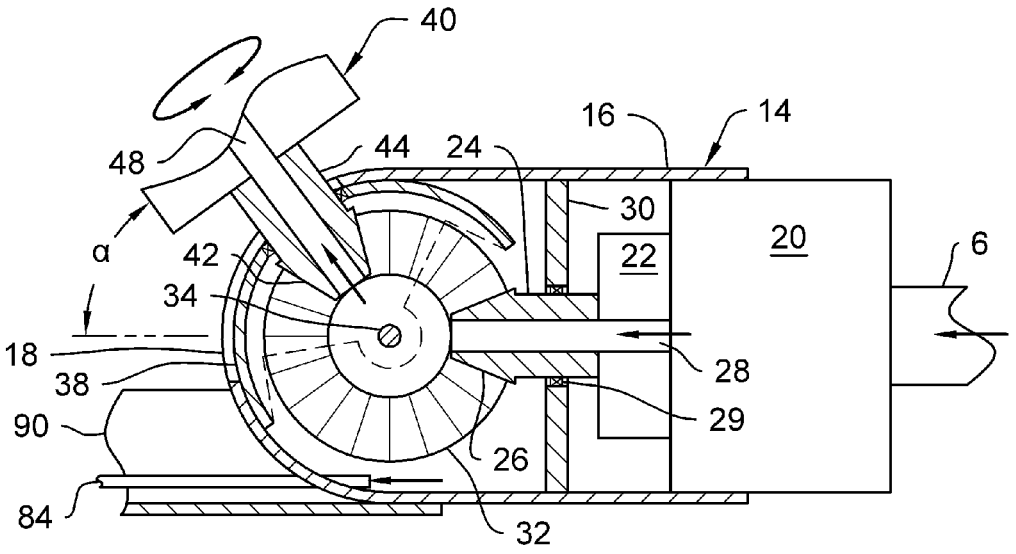
FIG. 6 is a cross-sectional view of the FTT unit in the deployed configuration.

Referring to FIGS. 5 and 6, the cutter bit 40 includes at least one driver shaft 24 rotatably secured to at least one internal support 30 via at least one bearing 29. The driver shaft 24 is operatively connected to the mud motor via the adapter 22, which rotates and provides torque to the driver shaft 24. At least one driver pinion gear 26 is located at an end of the driver shaft 24. At least one driver passage 28 is defined through the driver pinion gear 26 and driver shaft 24, and the driver passage 28 is in fluid communication with the adapter 22 and/or bottom hole assembly 20, and the interior of the FTT unit 14.

Figure 4:
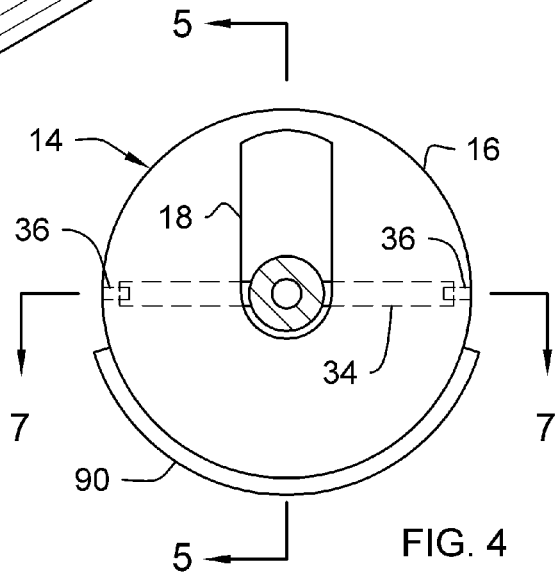
FIG. 4 is a front elevational view of the FTT unit of the present invention.
Figure 7:
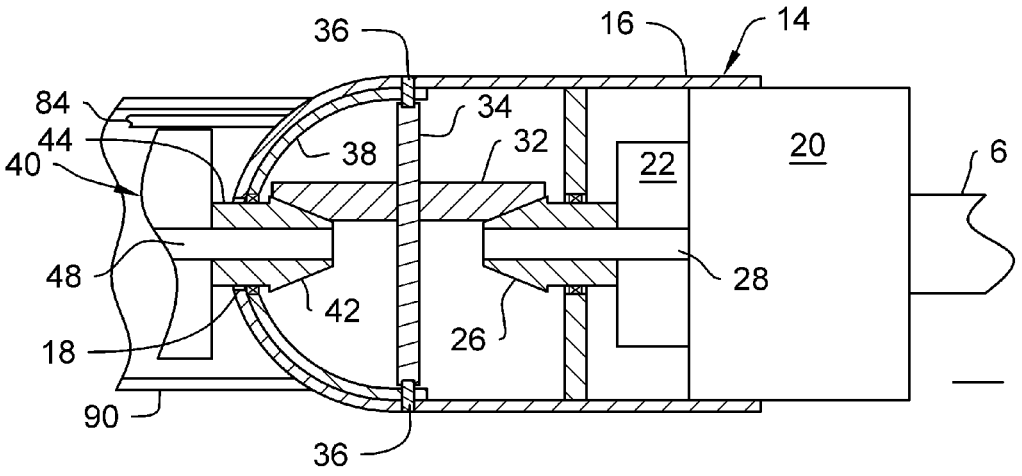
FIG. 7 is a cross-sectional view of the FTT unit in the retracted configuration taken along line 7-7 in FIG. 4.

At least one crown gear 32 is located in the interior of the FTT unit 14, and is engageable with the driver pinion gear 26. The crown gear 32 may be located perpendicular to the driver pinion gear 26, and rotates about a shaft 34 running the width of the FTT unit 14. The shaft 34 is coupled to the outer housing 16 by a pair of pins 36, as best illustrated in FIGS. 4 and 7.

The FTT unit 14 further includes a semi-spherical cover or interior housing 38 that is pivotable attached to the shaft 34 or the pins 36 via side walls of the interior housing 38. The interior housing 38 has a profile that corresponds with the profile of the end of the outer housing 16 that defines the slot 18. The interior housing 38 is dimensioned to cover the slot 18 while in the retracted and deployed configurations.

The cutter bit 40 includes at least one bit pinion gear 42, at least one bit shaft 44, and at least one bit passage 48 defined through the bit pinion gear 42 and the bit shaft 44. The bit passage 48 is in fluid communication with the interior of the FTT unit 14. The bit shaft 44 is received through the slot 18, and is rotatably supported and received through an opening in the interior housing 38 via a bit bearing 46, thereby allowing the cutter bit 40 to pivot with the interior housing 38 about the shaft 34. The bit pinion gear 42 is positioned within the interior of the FTT unit 14 and is engageable with the crown gear 32 during its entire pivoting travel.

In the retracted configuration, as best illustrated in FIG. 5, the cutter bit 40 is parallel or in-line with the FTT unit 14, thereby reducing its cross-sectional profile and allowing the subsurface formation cutter 10 to travel within the wellbore. During operation, the cutter bit 40 is pivoted about the shaft 34 to a predetermined cutter bit angle $\alpha$ with relation to the longitudinal axis of the FTT unit 14, as best illustrated in FIG. 6. A drilling mud or fluid is pumped through the drill string 6 into the bottom hole assembly 20. The drilling mud powers the mud motor which rotates the driver shaft 24 and driver pinion gear 26. The rotating driver pinion gear 26 drives and rotates the crown gear 32 about the shaft 34, which in turn drives and rotates the bit pinion gear 42 of the cutter bit 40. The bit pinion gear 42 rotates the cutter bit 40 so as to provide a drilling or cutting operation into the formation 2.

After exiting the adapter 22, the mud then travels through the driver passage 28 and into the interior of the FTT unit 14. The mud circulates throughout the interior of the FTT unit 14 to lubricate the driver pinion gear 26, the crown gear 32 and the bit pinion gear 42.

The interior housing 38 is further dimensions to produce a partial seal between the interior of the FTT unit 14 the wellbore or annulus, thereby creating positive pressure in the interior of the FTT unit 14 because of the mud being pumping therein. This positive pressure prevents debris or foreign material from entering the interior of the FTT unit 14, thereby reducing wear and damage to the gears and components located in the interior of the FTT unit 14. This positive pressure also forces some of the mud through the bit passage 48 and into the cutter bit 40. It can be appreciated that the interior housing 38 may also be configured to produce a fluid-tight or full seal to the outer housing 16, the fluid-tight or full seal may be produced by a sealing ring positioned in a groove around the slot 18, and around the inside of the housing 16. It can be further appreciated that the interior housing 38 may include controllable ports or valves to deliver the mud exterior of the FTT unit 14.

Figure 8:
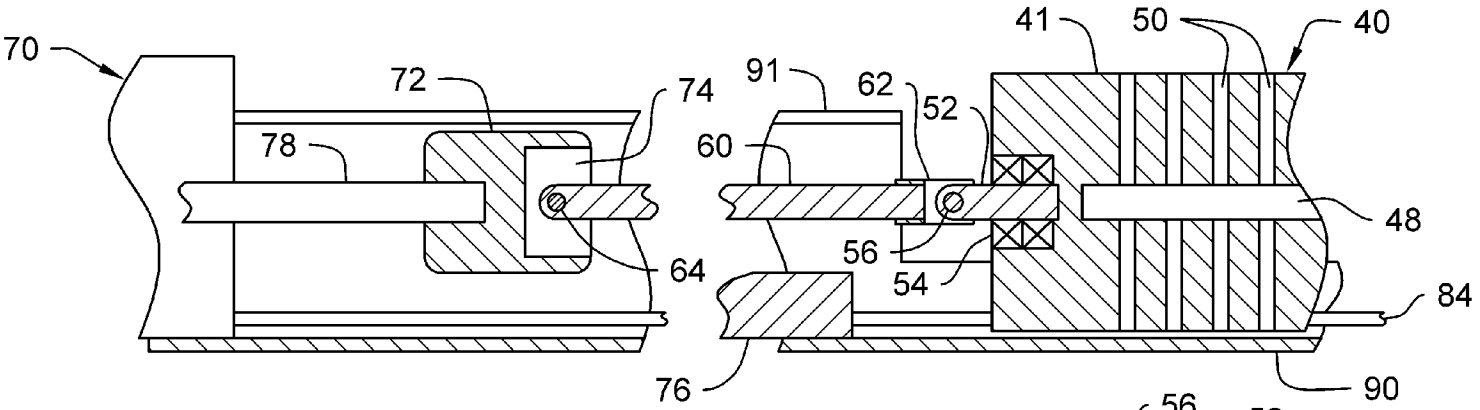
FIG. 8 is a cross-sectional view of the cutter bit, the bit brace and the traveling member of the present invention in the retracted configuration.
Figure 9:
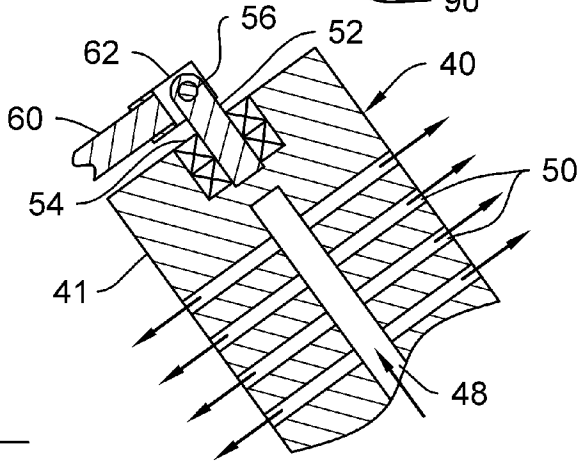
FIG. 9 is a cross-sectional view of the cutter bit, the bit brace and the traveling member of the present invention in the deployed configuration.
Figure 9:
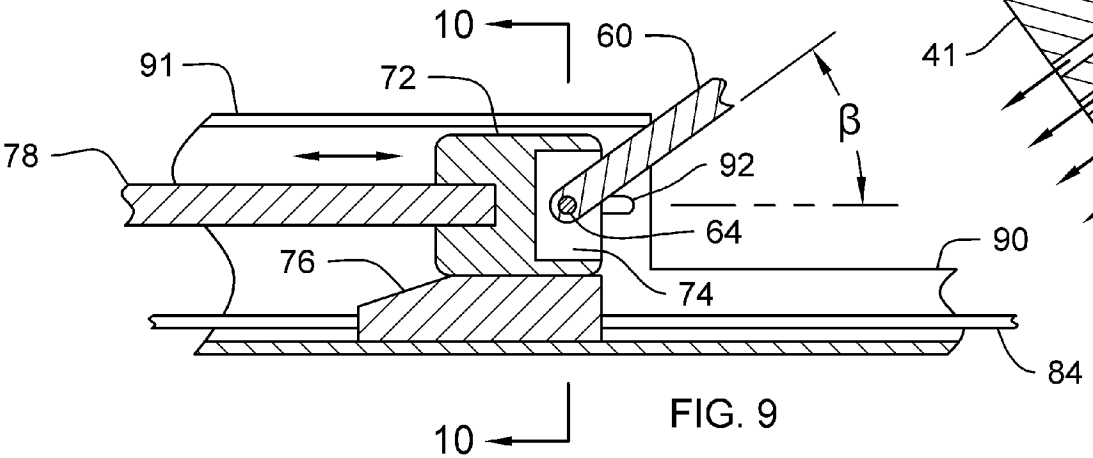

Referring to FIGS. 8 and 9, the cutter bit 40 is pivotable connected to the bit brace 60, which is pivotably connected to at least one traveling member or sliding block 72. The cutter bit 40 further includes at least one cutter body 41, and at least one connector member 52 rotatably coupled to the cutter body 41 via at least one bearing 54. The bit passage 48 is defined in the cutter body 41 along a portion of the length of the cutter body 41, with outlet ports 50 radially defined through the cutter body 41 in communication with the bit passage 48. Mud from the FTT unit 14 is allowed to travel through the cutter bit 40 and out the outlet ports 50 to assist in the removal of cuttings and/or debris from an area adjacent the cutter body 41.

A free end of the connector member 52 is pivotably connected to the bit brace 60 by way of a bit brace fitting 62 and a bit pin 56. The configuration of the free end of the connector member 52 and the bit brace fitting 62 prevents the connector member 52 from rotating. A first end of the bit brace 60 is attached to the bit brace fitting 62, and a second end of the bit brace 60 is pivotably connected to the traveling member 72 via a block pin 64. The bit brace 60 may be an elongated member having a configuration that resists buckling in tension and compression.

The traveling member 72 includes a cavity 74 defined therein and facing the cutter bit 40. The cavity 74 may be configured to receive a portion of the bit brace 60 therein during its entire pivoting travel.

The ram unit 70 has at least one ram shaft 78 that is connected to the traveling member 72 so as to provide linear movement to the traveling member 72 along the connection member 90 in a direction parallel with the longitudinal axis of the FTT unit 14.

Figure 10:
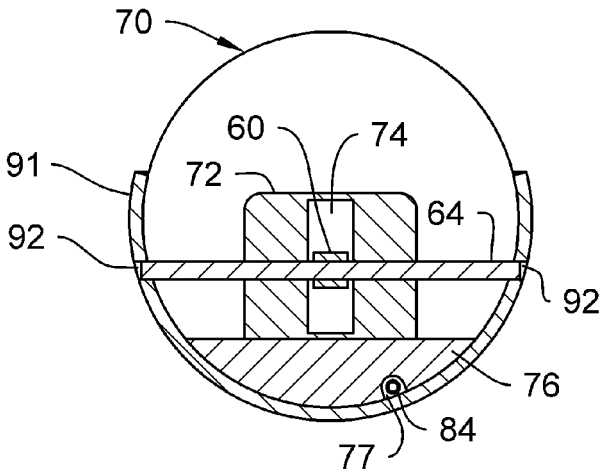
FIG. 10 is a cross-sectional view of the traveling member engaged with the friction block taken along line 10-10 in FIG. 9.

A free end of the connection member 90 is connected to the ram unit 70, thereby providing a rigid connection between the ram unit 70 and the FTT unit 14, consequently providing resistance to the ram unit 70 while moving the traveling member 72. The connection member 90 includes a traveling member portion 91 that has a larger area or radial arc so as to produce side walls that extend higher than the traveling member 72. The traveling member portion 91 has a pair of slots 92 defined therein or therethrough that are parallel with the linear travel of the traveling member 72. The slots 92 are configured to receive free ends or portions of the block pin 64, as best illustrated in FIG. 10. The slots 92 guide the traveling member 72 during its travel, and prevent unwanted directional movement or rotation of the traveling member 72.

At least one semi-locking friction block 76 is attached to or formed in a bottom portion of the connection member 90 at a location of terminal travel of the traveling member 72 in the deployed configuration, as best illustrated in FIG. 10. The friction block 76 includes a bottom surface profile that corresponds with a profile of the connection member 90, a substantially planar top side, and an angled surface facing toward the ram unit 70. It can be appreciated that the friction block 76 may be removably attachable to the connection member 90, thereby allowing the friction block to be positioned in various locations along the connection member 90.

At least one fluid line 84 connects the ram unit 70 to the FTT unit 14 for providing operational fluid or mud to the ram unit 70. The fluid line 84 travels along an interior of the connection member 90. In the alternative, the friction block 76 may include at least one channel 77 defined along the surface in contact with the connection member 90, and the channel 77 may be configured to receive the fluid line 84 therethrough. It can be appreciated that the fluid line 84 may be secured to the connection member 90 so as not to interfere with the traveling member 72 and friction block 76.

In the retracted configuration, as best illustrated in FIG. 8, the cutter bit 40, the bit brace 60 and the ram shaft 78 are all substantially parallel or in-line with the FTT unit 14, thereby reducing its cross-sectional profile and allowing the subsurface formation cutter 10 to travel within the wellbore. During operation, the ram shaft 78 linearly moves thus pushing the traveling member 72 along the traveling member portion 91 until the ram shaft 78 reaches in terminal distance or to the deployed configuration determined by the position of the friction block 76. At this terminal distance, the traveling member 72 will contact the angled end of the friction block 76 and force the traveling member 72 onto the top side of the friction block 76. The friction between the top surface of the friction block 76 and the traveling member 72 is sufficient to temporally lock or hold the traveling member 72 in the deploy configuration. The traveling member 72 consequently pushes against the bit brace 60 and the cutter bit 40, which thus results in the bit brace 60 and cutter bit 40 to buckle at their pivotable connections and placing the cutter bit 40 in the deployed configuration, as best illustrated in FIG. 9.

During this deploying operation, the bit brace 60 is pivoted about the bit pin 56 and the block pin 64 to a predetermined bit brace angle $\beta$ with relation to the longitudinal axis of the FTT unit 14. The bit brace angle $\beta$ is directly related to the cutter bit angle $\alpha$. Thus different lengths of the bit brace 60 or ram shaft 78 can be used to produce a desired bit brace angle $\beta$ which in turn produces a specific cutter bit angle $\alpha$. Predetermined cutter bit angles $\alpha$ can be calculated prior to deployment of the present invention to produce the cut channel or furrow 12 with specific dimensions or configurations.

Figure 11:
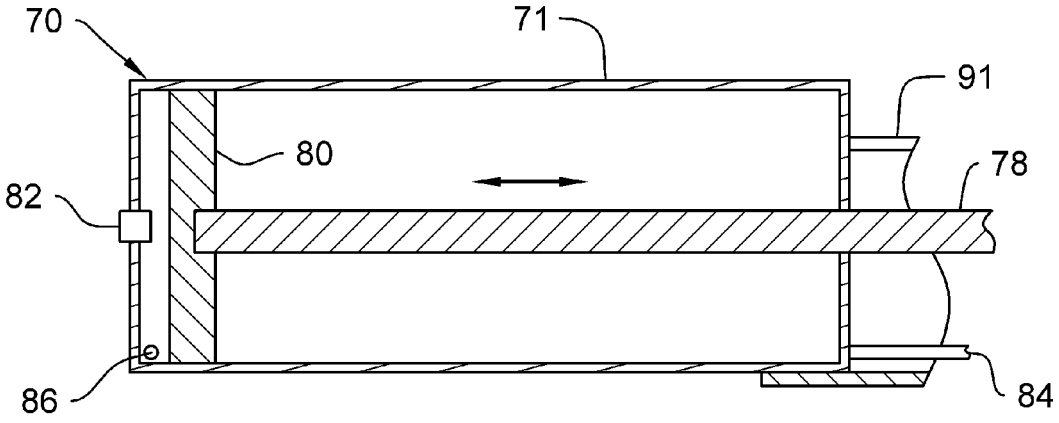
FIG. 11 is a cross-sectional view of the ram unit of the present invention in the retracted configuration.
Figure 12:
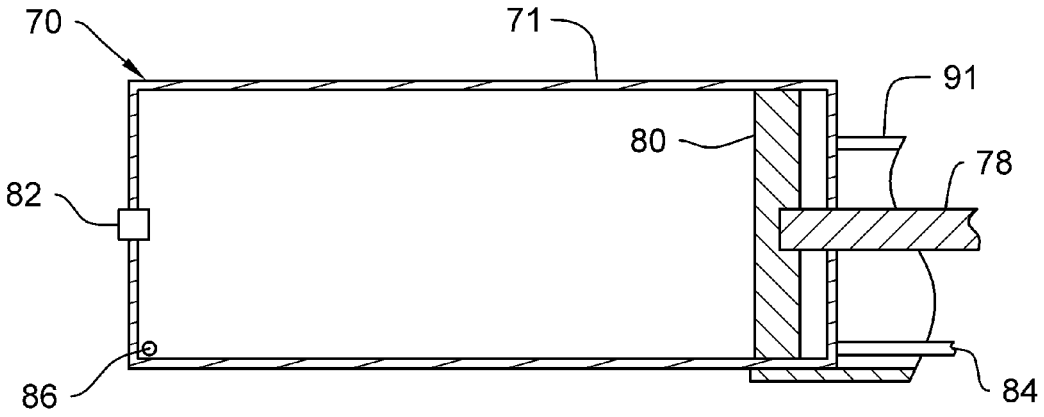
FIG. 12 is a cross-sectional view of the ram unit of the present invention in the deployed configuration.

Referring to FIGS. 11 and 12, the ram unit 70 includes a cylindrical ram housing 71, at least one piston 80 connected to an end of the ram shaft 78, and at least one dump valve 82 located an end of the housing opposite the ram shaft exiting end. The ram shaft 78 extends through one end of the ram housing 71. The piston 80 is slidably received in an interior of the ram housing 71. The fluid line 84 is in communication with the interior of the ram housing 71 by way of a communication port 86, so as to deliver driving fluid force to the piston 80 to drive the piston to the deployed configuration. It can be appreciated that multiple independently controlled fluid lines that connect to multiple ports located at opposite ends of the ram unit may be used to control and operate the piston in either direction.

It can also be appreciated that a motorized or electrical driving means can be used in place of the above described fluid operated ram unit 70.

Figure 13:
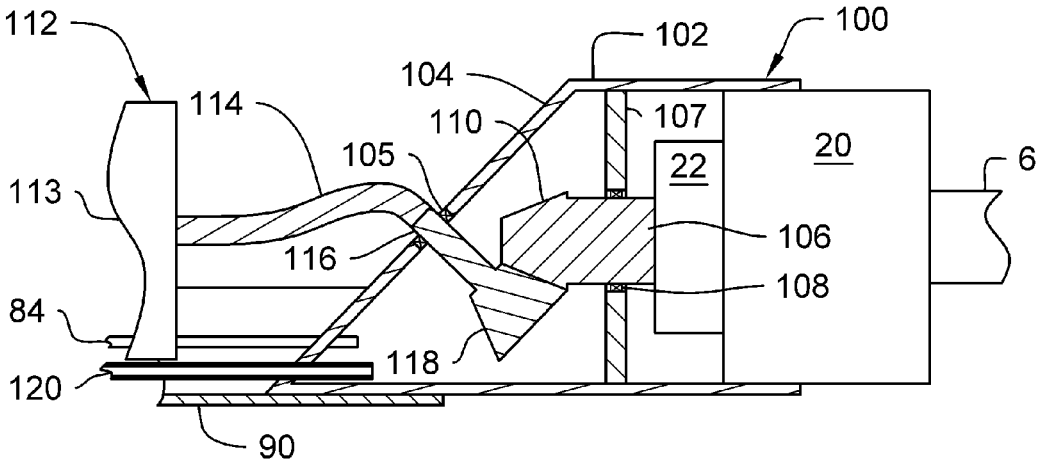
FIGS. 13 and 14 are cross-sectional views of an alternate embodiment of the FTT unit and cutter bit with the flexible shaft in the retracted and deployed configurations respectively.
Figure 14:
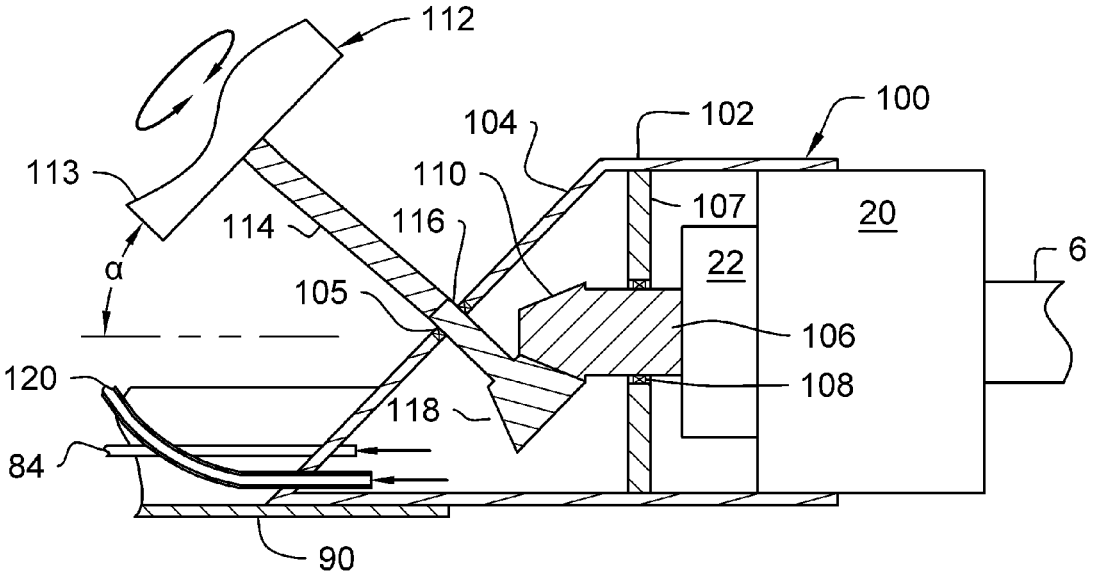

In FIGS. 13 and 14, an alternate embodiment FTT unit 100 and cutter bit 112 are illustrated and will be described. The FTT unit 100 is operable connected to the mud or fluid motor of the bottom hole assembly 20 via the adapter 22. The FTT unit 100 includes an outer housing 102 having an angled end 104 featuring a bore adapted to allow a bit shaft 116 of the cutter bit 112 to extend therethrough. The connection member 90 may also be attached to the outer housing 102, the adapter 22 or the drill string 6. The angled end 104 may be a flat planar surface, and the outer housing 102 may be cylindrical to assist in its travel through the wellbore.

At least one driver shaft 106 is rotatably secured to an internal support 107 via at least one bearing 108. The driver shaft 106 is operatively connected to the mud motor via the adapter 22, which rotates and provides torque to the driver shaft 106. At least one driver pinion gear 110 is located at an end of the driver shaft 106, and is configured to rotate with the driver shaft 106 upon operation by the mud motor.

The cutter bit 112 includes a cutter body 113, a bit shaft 116 rotatably secured to the angled end 104 via at least one bearing 105, at least one bit pinion gear 118 located at an end of the bit shaft 116. The bit shaft 116 is positioned such that driver pinion gear 110 and bit pinion gear 118 are engaged. At least one flexible drive shaft 114 is connected to a free end of the bit shaft 116 exterior of the FTT unit 100, and to the cutter body 113, thereby providing angular flexible and movement of the cutter body 113 in relation to the longitudinal axis of the FTT unit 100.

The cutter bit 112 further includes at least one flexible fluid line 120 connected to the FTT unit 100 to provide fluid communication between the cutter bit 112 and the interior of the FTT unit 100.

In the retracted configuration, as best illustrated in FIG. 13, the cutter bit 112 is substantially parallel or in-line with the longitudinal axis of the FTT unit 100, thereby reducing its cross-sectional profile and allowing the subsurface formation cutter 10 to travel within the wellbore. During operation, the cutter bit 112 is pivoted about the bit shaft 116 to a predetermined cutter bit angle $\alpha$ with relation to the longitudinal axis of the FTT unit 100, as best illustrated in FIG. 14. A drilling mud or fluid is pumped through the drill string 6 into the bottom hole assembly 20. The drilling mud powers the mud motor which rotates the driver shaft 106 and pinion gear 110.

The rotating pinion gear 110 drives and rotates the bit pinion gear 118 of the cutter bit 112. The bit pinion gear 118 rotates the bit shaft 116 which in turn produces rotational torque to the flexible drive shaft 114, which then rotates the cutter body 113.

It can be appreciated that the FTT unit 100 can further include controllable ports or valves to deliver the mud exterior of the FTT unit 100.

Figure 15:
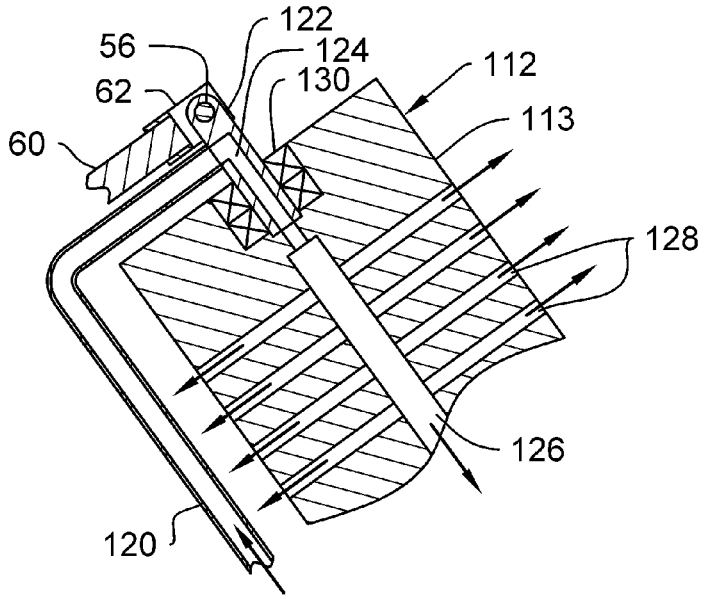
FIG. 15 is a cross-sectional view of an alternate embodiment of the cutter bit in the deployed configuration.

As best illustrated in FIG. 15, the cutter bit 112 is pivotable connected to the bit brace 60, which is pivotably connected to the traveling member. The cutter bit 112 further includes at least one connector member 122 rotatably coupled to the cutter body 113 via at least one bearing 130. A bit passage 126 is defined in the cutter body 113 along a portion of the length of the cutter body 113, and a connector passage 124 is defined in the connector member 122. The connector passage 124 is connected to and in fluid communication with the flexible fluid line 120 and the bit passage 126. Outlet ports 128 are radially defined through the cutter body 113 and which are in communication with the bit passage 126. Mud from the FTT unit 100 travels through the flexible fluid line 120 and the connector passage 124, and then out the outlet ports 128 to assist in the removal of cuttings and/or debris from an area adjacent the cutter body 113.

A free end of the connector member 122 is pivotably connected to the bit brace fitting 62 via the bit pin 56. The configuration of the free end of the connector member 122 and the bit brace fitting 62 prevents the connector member 122 from rotating. The bit brace 60 is pivotably connected to the traveling member, as described above.

Figure 16:
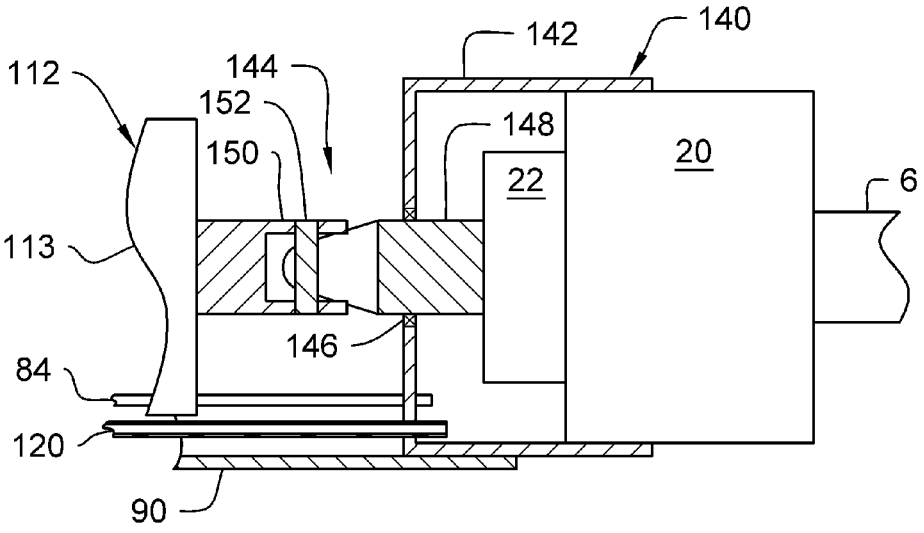
FIGS. 16 and 17 are cross-sectional views of an alternate embodiment of the FTT unit and cutter bit with the universal joint in the retracted and deployed configurations respectively.
Figure 17:
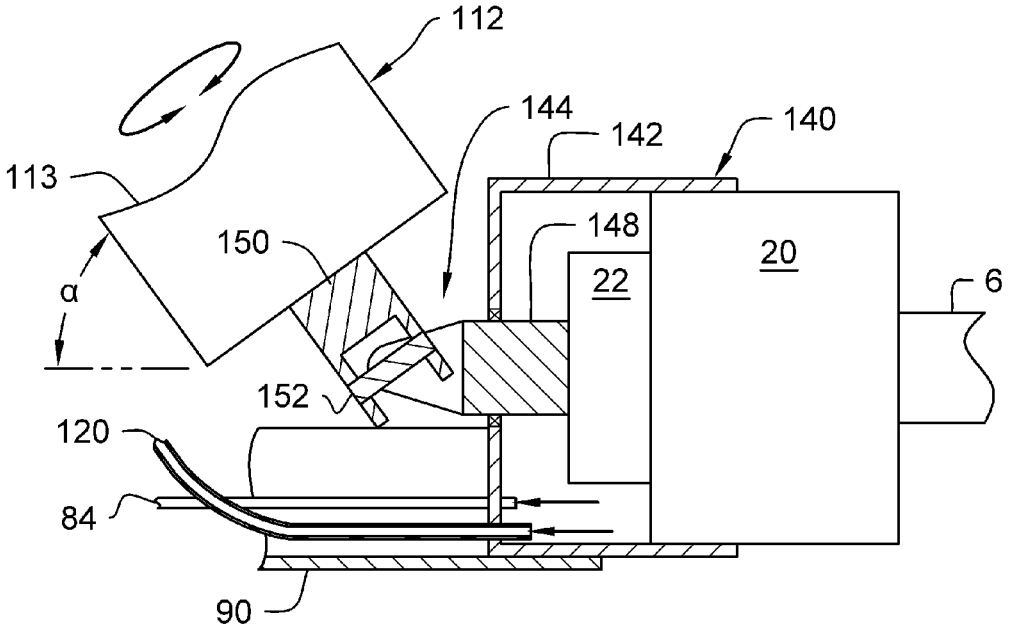

In FIGS. 16 and 17, an alternate embodiment FTT unit 140 and cutter bit 112 are illustrated and will be described. The FTT unit 140 is operable connected to a mud or fluid motor of the bottom hole assembly 20 via an adapter 22. The FTT unit 140 includes an outer housing 142 having a planar end featuring a bore adapted to allow a driver shaft 148 to extend therethrough. The connection member 90 may also be attached to the outer housing 16, the adapter 22 or the drill string 6. The outer housing 142 can be cylindrical to assist in its travel through the wellbore.

The driver shaft 148 is rotatably secured to the planar end of the outer housing 142 via a bearing 146. The driver shaft 148 is operatively connected to the mud motor via the adapter 22, which rotates and provides torque to the driver shaft 148.

The cutter bit 112 includes the cutter body 113 and a bit shaft 150. A free end of the bit shaft 150 and a free end of the driver shaft 148 are articulately connected together by way of a universal joint 144 including a joint pin 152. The universal joint 144 provides angular flexible and movement of the cutter bit 112 in relation to the longitudinal axis of the FTT unit 140. The universal joint 144 is exemplary of replacement drive systems for the cutter bit of the present invention.

The cutter bit 112 further includes a flexible fluid line 120 connected to the FTT unit 140 to provide fluid communication between the cutter bit 112 and the interior of the FTT unit 140.

In the retracted configuration, as best illustrated in FIG. 16, the cutter bit 112 is substantially parallel or in-line with the longitudinal axis of the FTT unit 140, thereby reducing its cross-sectional profile and allowing the subsurface formation cutter 10 to travel within the wellbore. During operation, the cutter bit 112 is pivoted about the universal joint 144 to a predetermined cutter bit angle $\alpha$ with relation to the longitudinal axis of the FTT unit 140, as best illustrated in FIG. 17. A drilling mud or fluid is pumped through the drill string 6 into the bottom hole assembly 20. The drilling mud powers the mud motor which rotates the driver shaft 148.

The rotating driver shaft 148 rotates the universal joint 144, which in turn drives and rotates the bit shaft 150 of the cutter bit 112.

It can be appreciated that the FTT unit 100 can further include controllable ports or valves to deliver the mud exterior of the FTT unit 100. It can further be appreciated that a flexible drive shaft may be connected between the cutter body 113 and the shaft 148, thereby replacing the universal joint 144.

The cutter bit 112 further includes the above described connector member coupled to the cutter body 113 via at least one bearing. A free end of the connector member is pivotably connected to the bit brace fitting via the bit pin. The configuration of the free end of the connector member and the bit brace fitting prevents the connector member from rotating. The bit brace is pivotably connected to the traveling member, as described above.

Figure 18:
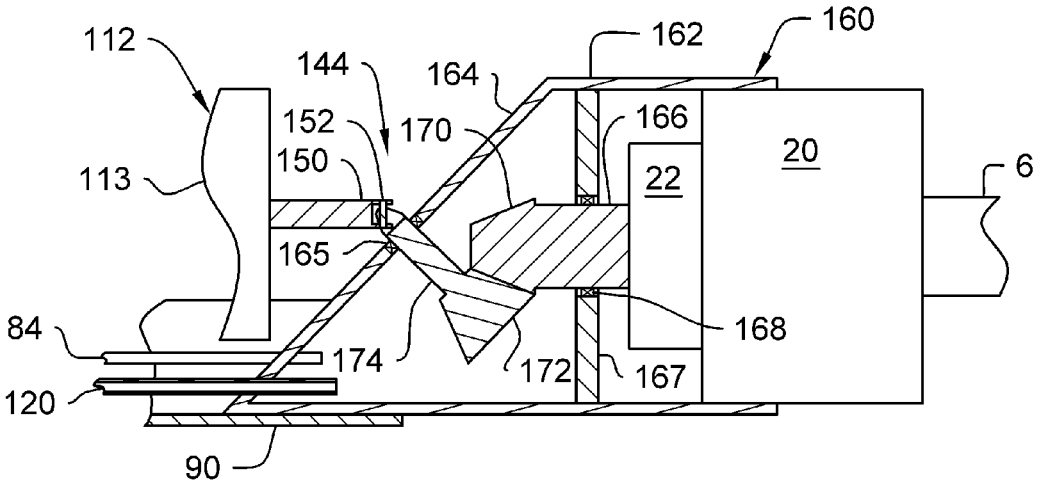
FIGS. 18 and 19 are cross-sectional views of an alternate embodiment of the FTT unit and cutter bit with an alternate embodiment universal joint in the retracted and deployed configurations respectively.
Figure 19:
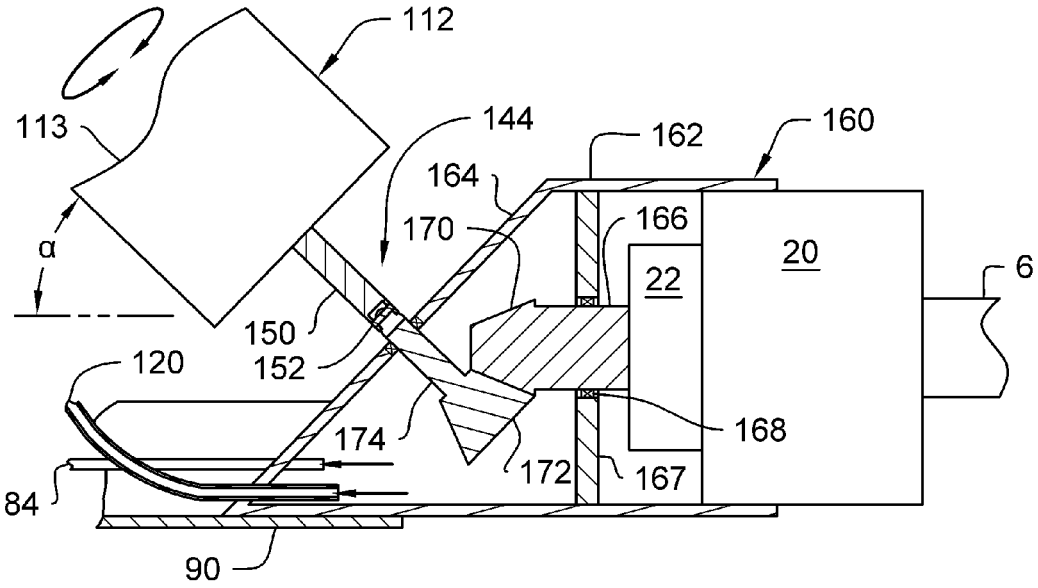

In FIGS. 18 and 19, an alternate embodiment FTT unit 160 and cutter bit 112 are illustrated and will be described. The FTT unit 160 is operable connected to a mud or fluid motor of the bottom hole assembly 20 via an adapter 22. The FTT unit 160 includes an outer housing 162 having an angled end 164 featuring a bore adapted to allow a bit shaft assembly of the cutter bit 112 to extend therethrough. The connection member 90 may also be attached to the outer housing 162, the adapter 22 or the drill string 6. The angled end 164 may be a flat planar surface, and the outer housing 162 may be cylindrical to assist in its travel through the wellbore.

A driver shaft 166 is rotatably secured to an internal support 167 via a bearing 168. The driver shaft 166 is operatively connected to the mud motor via the adapter 22, which rotates and provides torque to the driver shaft 166. A driver pinion gear 170 is located at an end of the driver shaft 166, and is configured to rotate with the driver shaft 166 upon operation by the mud motor.

The cutter bit 112 includes the cutter body 113, a bit shaft assembly, and a bit pinion gear 172. The a bit shaft assembly includes a first bit shaft 174 rotatably secured to the angled end 164 via a bearing 165, and a bit shaft 150 articulately connected to the first bit shaft 174 via a universal joint 144 exterior of the FTT unit 160. The bit pinion gear 172 is located at an end of the first bit shaft 174 and positioned within the interior of the FTT unit 160 so as to be engageable with the teeth of the driver pinion gear 170. The direct engagement of the driver pinion gear 170 and the bit pinion gear 172 is exemplary of replacement drive systems for the cutter bit of the present invention.

The cutter bit 112 further includes a flexible fluid line 120 connected to the FTT unit 160 to provide fluid communication between the cutter bit 112 and the interior of the FTT unit 160.

In the retracted configuration, as best illustrated in FIG. 18, the cutter bit 112 is substantially parallel or in-line with the longitudinal axis of the FTT unit 160, thereby reducing its cross-sectional profile and allowing the subsurface formation cutter 10 to travel within the wellbore. During operation, the cutter bit 112 is pivoted about the universal joint 144 to a predetermined cutter bit angle $\alpha$ with relation to the longitudinal axis of the FTT unit 160, as best illustrated in FIG. 19. A drilling mud or fluid is pumped through the drill string 6 into the bottom hole assembly 20. The drilling mud powers the mud motor which rotates the driver shaft 166 and driver pinion gear 170.

The driver pinion gear 170 drives and rotates the bit pinion gear 172 of the cutter bit 112. The bit pinion gear 172 then rotates the first bit shaft 174 which in turn drives and rotates the bit shaft 150 via the universal joint 144. The bit shaft 150 then rotates the cutter body 113.

It can be appreciated that the FTT unit 160 can further include controllable ports or valves to deliver the mud exterior of the FTT unit 160. It can further be appreciated that a flexible drive shaft may be connected between the cutter body 113 and the first bit shaft 174, thereby replacing the universal joint 144.

The cutter bit 112 further includes the above described connector member coupled to the cutter body 113 via at least one bearing. A free end of the connector member is pivotably connected to the bit brace fitting via the bit pin. The configuration of the free end of the connector member and the bit brace fitting prevents the connector member from rotating. The bit brace is pivotably connected to the traveling member, as described above.

Figure 20:
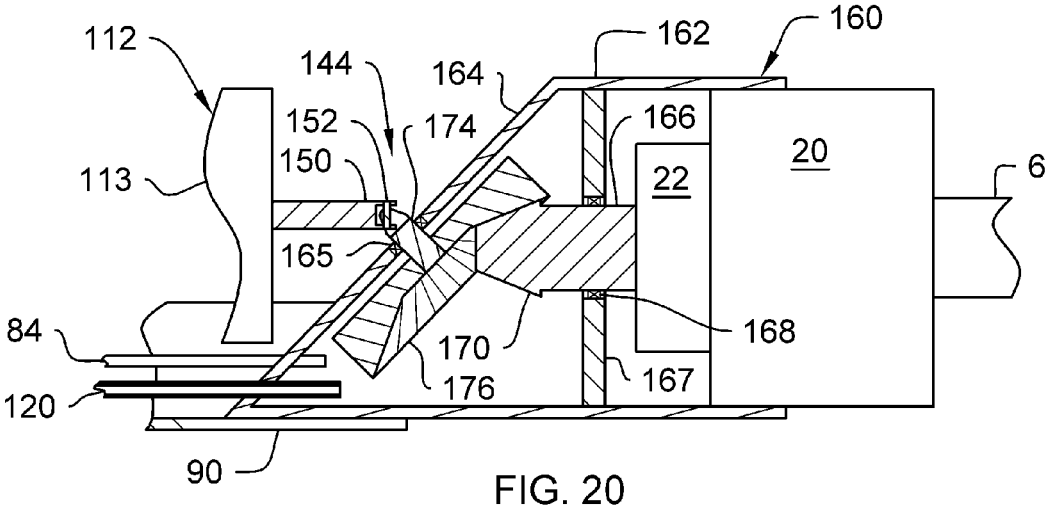
FIGS. 20 and 21 are cross-sectional views of an additional alternate embodiment of the FTT unit and cutter bit with an alternate embodiment universal joint in the retracted and deployed configurations respectively.
Figure 21:
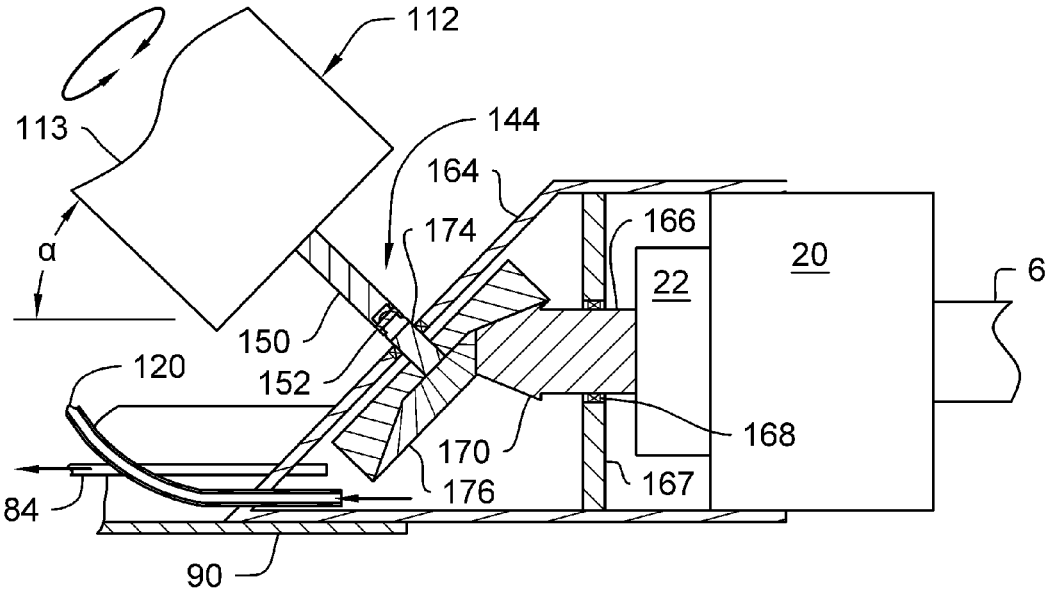

In FIGS. 20 and 21, an alternate embodiment cutter bit 112 is illustrated and will be described with the alternate embodiment FTT unit 160. As described above, the FTT unit 160 is operable connected to a mud or fluid motor of the bottom hole assembly 20 via an adapter 22. The FTT unit 160 includes an outer housing 162 having an angled end 164 featuring a bore adapted to allow a bit shaft assembly of the cutter bit 112 to extend therethrough. The connection member 90 may also be attached to the outer housing 162, the adapter 22 or the drill string 6. The angled end 164 can be a flat planar surface, and the outer housing 162 can be cylindrical to assist in its travel through the wellbore.

A driver shaft 166 is rotatably secured to an internal support 167 via a bearing 168. The driver shaft 166 is operatively connected to the mud motor via the adapter 22, which rotates and provides torque to the driver shaft 166. A driver pinion gear 170 is located at an end of the driver shaft 166, and is configured to rotate with the driver shaft 166 upon operation by the mud motor.

The cutter bit 112 includes a cutter body 113, a bit shaft assembly, and a bit ring gear 176 located at an end of the bit shaft assembly. The bit shaft assembly includes a first bit shaft 174 rotatably secured to the angled end 164 via a bearing 165, and a bit shaft 150 articulately connected to the first bit shaft 174 via a universal joint 144 exterior of the FTT unit 160. The bit ring gear 176 is positioned inside the FTT unit 160 so that teeth of the driver pinion gear 170 are engageable with internal teeth of the bit ring gear 176. The engagement of the driver pinion gear 170 and the bit ring gear 176 is exemplary of replacement drive systems for the cutter bit of the present invention.

The cutter bit 112 further includes a flexible fluid line 120 connected to the FTT unit 160 to provide fluid communication between the cutter bit 112 and the interior of the FTT unit 160.

In the retracted configuration, as best illustrated in FIG. 20, the cutter bit 112 is substantially parallel or in-line with the longitudinal axis of the FTT unit 160, thereby reducing its cross-sectional profile and allowing the subsurface formation cutter 10 to travel within the wellbore. During operation, the cutter bit 112 is pivoted about the universal joint 144 to a predetermined cutter bit angle $\alpha$ with relation to the longitudinal axis of the FTT unit 160, as best illustrated in FIG. 21. A drilling mud or fluid is pumped through the drill string 6 into the bottom hole assembly 20. The drilling mud powers the mud motor which rotates the driver shaft 166 and driver pinion gear 170.

The driver pinion gear 170 drives and rotates the bit ring gear 176 of the cutter bit 112. The bit ring gear 176 then rotates the first bit shaft 174 which in turn drives and rotates the bit shaft 150 via the universal joint 144. The bit shaft 150 then rotates the cutter body 113.

It can be appreciated that the FTT unit 160 can further include controllable ports or valves to deliver the mud exterior of the FTT unit 160. It can further be appreciated that a flexible drive shaft may be connected between the cutter body 113 and the shaft 174, thereby replacing the universal joint 144.

The cutter bit 112 further includes the above described connector member coupled to the cutter body 113 via at least one bearing. A free end of the connector member is pivotably connected to the bit brace fitting via the bit pin. The configuration of the free end of the connector member and the bit brace fitting prevents the connector member from rotating. The bit brace is pivotably connected to the traveling member, as described above.

In FIGS. 22-29, exemplary embodiments of the cutter bit 40, 112 are illustrated and will be described. Each cutter bit 40, 112 includes a cutter body 41, 113, and a connector member 52, 122 connected to the cutter body via a bit bearing. The bit bearing allows the cutter body 41, 113 to rotate while the connector member 52, 122 remains stationary and pivotably connected to the bit brace.

Figures 22, 23, 24, 25, 26, 27, 28, 29:
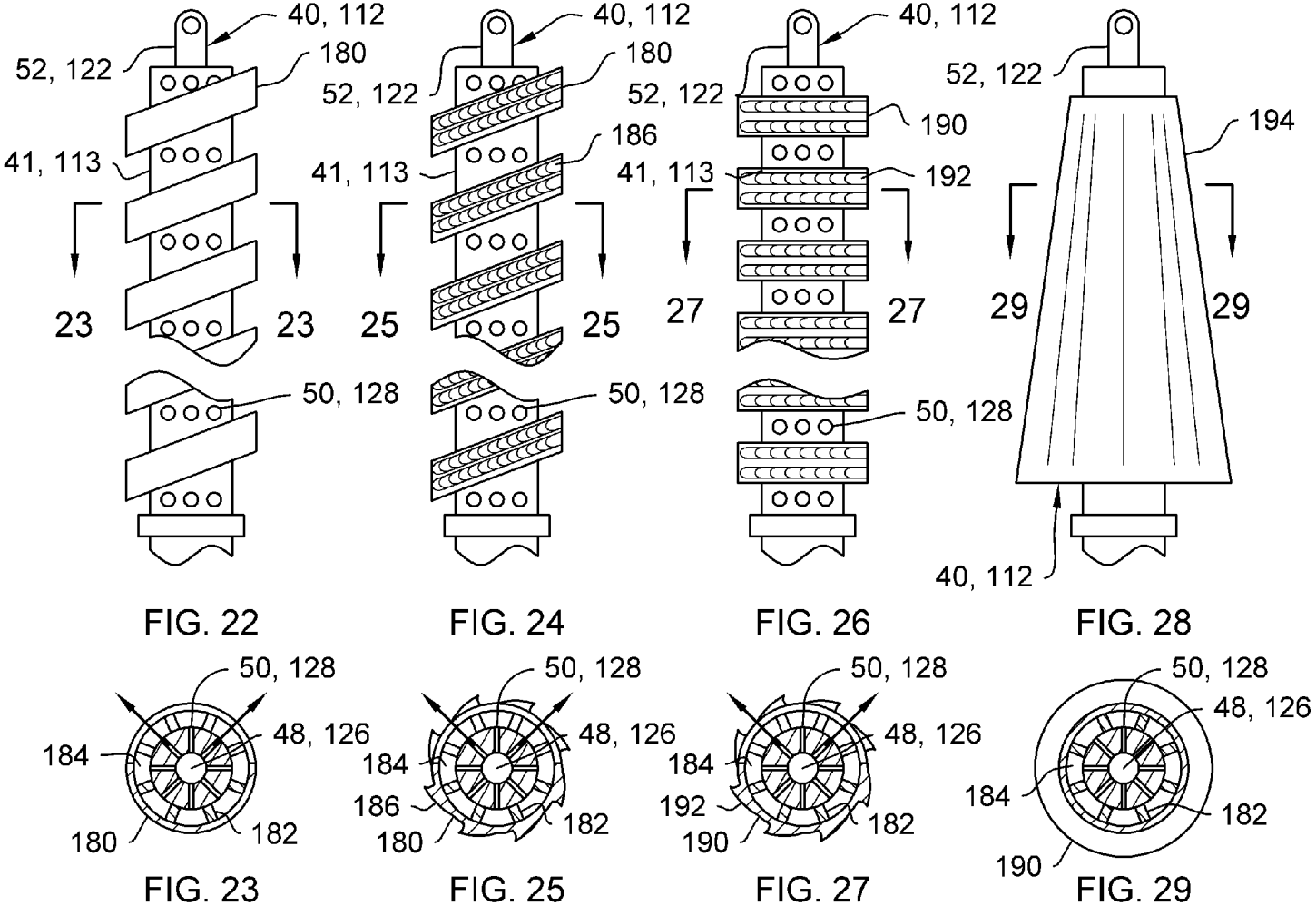
FIGS. 22-29 are cross-sectional views of alternate embodiments of the cutter bit of the present invention respectively.

An embodiment of the cutter bit 40, 112, as best illustrated in FIGS. 22 and 23, includes a spiral or helical bit 180 wound around the cutter body 41, 113, and a plurality of outlet ports 50, 128 defined in the cutter body and in fluid communication to the exterior of the cutter bit 40, 112. The spiral bit 180 is attached to the interiorly received cutter body 41, 113 by a plurality of radial support arms 182, which retain the spiral bit 180 in a spaced apart relationship with the cutter body. The spaced apart relationship of the spiral bit 180 and cutter body 41, 113 creates a gap 184 therebetween. The gap 184 allows fluid from the outlet ports 50, 128 to pass therethrough and assist in removal of cutting debris away from the cutter bit 40, 112.

An additional embodiment of the cutter bit 40, 112, as best illustrated in FIGS. 24 and 25, includes the spiral bit 180 wound around the cutter body 41, 113, the plurality of outlet ports 50, 128 defined in the cutter body and in fluid communication to the exterior of the cutter bit 40, 112, and a plurality of shearing and gouging elements 186 associated with the spiral bit 180. The shearing and gouging elements 186 may extend, protrude or recess from the spiral bit 180. The spiral bit 180 is attached to the interiorly received cutter body 41, 113 by a plurality of radial support arms 182, which retain the spiral bit 180 in a spaced apart relationship with the cutter body. The spaced apart relationship of the spiral bit 180 and cutter body 41, 113 creates a gap 184 therebetween. The gap 184 allows fluid from the outlet ports 50, 128 to pass therethrough and assist in removal of cutting debris away from the cutter bit 40, 112.

Still another embodiment of the cutter bit 40, 112, as best illustrated in FIGS. 26 and 27, includes multiple circular bits 190, a plurality of outlet ports 50, 128 defined in the cutter body and in fluid communication to the exterior of the cutter bit 40, 112, and a plurality of shearing and gouging elements 192 associated with the circular bits 190. The shearing and gouging elements 192 may extend, protrude or recess from the circular bits 190. The cutter body 41, 113 is centrally received in the circular bits 190, and the circular bits 190 are attached to the cutter body 41, 113 by a plurality of radial support arms 182, which retains the circular bits 190 in a spaced apart relationship with the cutter body. The spaced apart relationship of the circular bits 190 and cutter body 41, 113 creates a gap 184 therebetween. The gap 184 allows fluid from the outlet ports 50, 128 to pass therethrough and assist in removal of cutting debris away from the cutter bit 40, 112.

Even still another embodiment of the cutter bit 40, 112, as best illustrated in FIGS. 28 and 29, includes a conical bit 194, and a plurality of outlet ports 50, 128 defined in the cutter body and in fluid communication to the exterior of the cutter bit 40, 112. The cutter body 41, 113 is centrally received in the conical bit 194, and the conical bit 194 is attached to the cutter body 41, 113 by a plurality of radial support arms 182, which retains the conical bit 194 in a spaced apart relationship with the cutter body. The spaced apart relationship of the conical bit 194 and cutter body 41, 113 creates a gap 184 therebetween. The gap 184 allows fluid from the outlet ports 50, 128 to pass therethrough and assist in removal of cutting debris away from the cutter bit 40, 112. It can be appreciated that the conical bit 194 may include shearing and gauging elements.

It can further be appreciated that different dimensions of the spiral, circular or conical bits can be used to adjust the width and/or the depth of the channel, furrow or slot to be cut into the formation. Alternatively, spiral bit 180, circular bit 190 and/or conical bit 194 could be snugly fitted over and attached to their corresponding cutter body 41, 113 thereby eliminating the gap 184 and radial arms 182.

Figure 30:
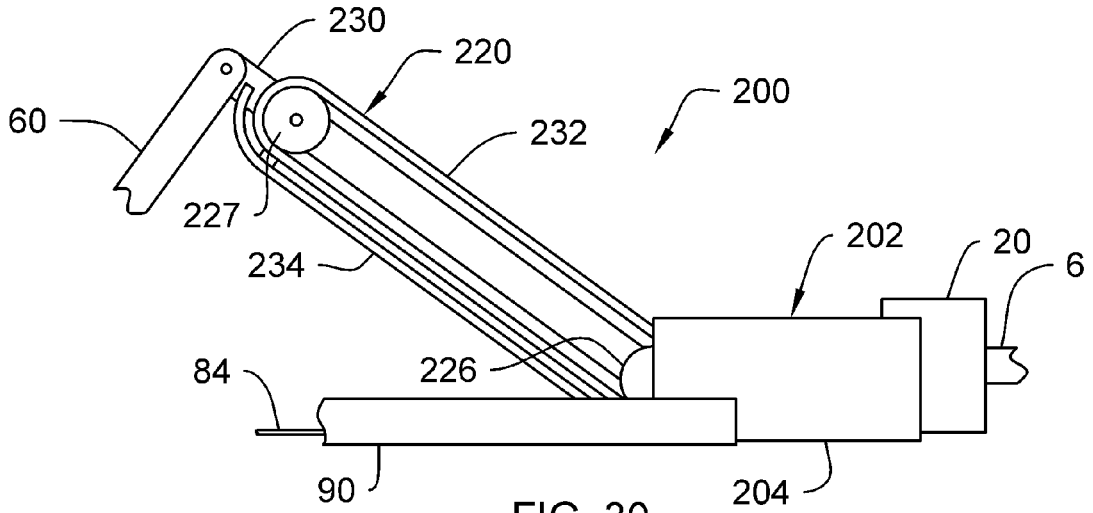
FIG. 30 is a side elevational view of an alternate embodiment of a FTT unit and chain cutter bit of the present invention.
Figure 31:
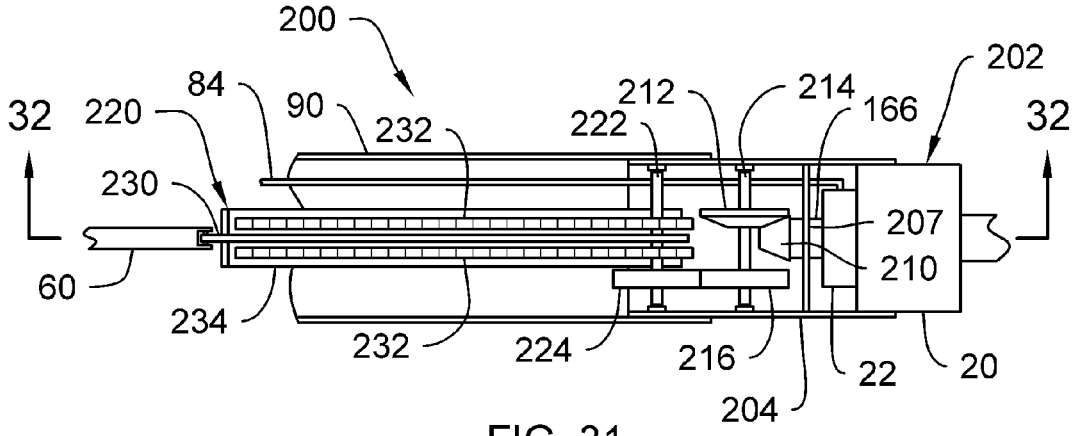
FIG. 31 is a top plane view of the alternate embodiment FTT unit and chain cutter bit of FIG. 30.
Figure 32:
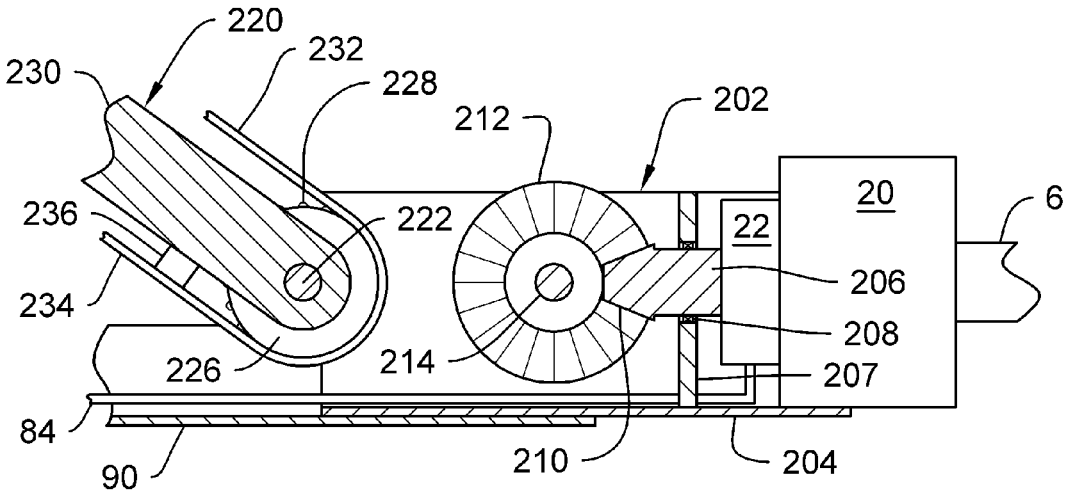
FIG. 32 is a cross-sectional view of the alternate embodiment FTT unit and chain cutter bit of the present invention taken along line 32-32 in FIG. 31.

In FIGS. 30-32, an alternate embodiment FTT unit and cutter bit assembly 200 of the subsurface formation cutter is illustrated and will be described. The alternate embodiment FTT unit and cutter bit assembly 200 includes a FTT unit 202 and a chain cutter bit 220. As described above, the FTT unit 202 is operable connected to a mud or fluid motor of the bottom hole assembly 20 via an adapter 22. The FTT unit 202 includes an outer housing 204 having an opened end configured to receive a portion of the chain cutter bit 220 therethrough. The connection member 90 may also be attached to the outer housing 16, the adapter 22 or the drill string 6. The outer housing 204 may be cylindrical to assist in its travel through the wellbore.

A driver shaft 206 is rotatably secured to an internal support 207 via a bearing 208. The driver shaft 206 is operatively connected to the mud motor via the adapter 22, which rotates and provides torque to the driver shaft 206. A driver pinion gear 210 is located at an end of the driver shaft 206, and is configured to rotate with the driver shaft 206 upon operation by the mud motor.

At least one crown gear 212 is located in the interior of the FTT unit 202, and is engageable with the driver pinion gear 210. The crown gear 212 is located perpendicular to the driver pinion gear 210, and is rigidly fitted to a shaft 214 running the width of the FTT unit 202, thereby providing rotational torque to the shaft 214. The shaft 214 is rotatably coupled to the outer housing 204 by a pair of pins, as best illustrated in FIGS. 31 and 32. At least one intermediate gear 216 is rigidly fitted to the shaft 214 so as to rotate with the shaft 214 and the crown gear 212.

The chain cutter bit 220 includes a chain driving gear 224, a driven sprocket 226, an idler sprocket or wheel 227, at least one connector member 230, at least one cutter chain 232, and a shield or guard 234. The chain driving gear 224 and the driven sprocket 226 are rigidly fitted to a chain shaft 222, so that they rotate together. The chain driving gear 224 is positioned so as to be engageable with the intermediate gear 216. The chain shaft 222 is rotatably coupled to the outer housing 204 by a pair of pins, thereby allowing the chain cutter bit 220 to pivot about a longitudinal axis of the chain shaft 222.

It can be appreciated that the crown gear 212 and the intermediate gear 216 may be combined into a single gear that is engageable with both the driver pinion gear 210 and the chain driving gear 224.

The driven sprocket 226 includes a plurality of sprocket teeth 228 radially protruding from an edge thereof so as to engage and drive the cutter chain 232 wrapped therewith around.

The connector member 230 is rotatably coupled to the chain shaft 222, and extends out past the length of the cutter chain 232. A free end of the connector member 230 is pivotably connected to the bit brace 60 via a bit pin or a bit brace fitting. The configuration of the free end of the connector member 230 and the bit brace 60 provides support and pivotal movement to the chain cutter bit 220. The bit brace 60 is pivotably connected to the traveling member, as described above.

The idler sprocket 227 is rotatably coupled to the connector member 230 near the end of the connector member 230 that is pivotably connected to the bit brace 60. The idler sprocket 227 is rotatably coupled to the connector member 230 via a pin, thus allowing the idler sprocket 227 to freely rotate. The cutter chain 232 is wound around the idler sprocket 227, thereby creating an endless cutter chain about the driven sprocket 226 and the idler sprocket 227.

The shield 234 is attached to the connector member 230 by multiple support members 236, which positions the shield 234 away from the cutter chain 232 and protects the cutter chain 232 from contacting the outer housing 204, the fluid line 84 and/or the connection member 90.

In the retracted configuration the chain cutter bit 220 is substantially parallel or in-line with the longitudinal axis of the FTT unit 202, thereby reducing its cross-sectional profile and allowing the FTT unit and cutter bit assembly 200 to travel within the wellbore. During operation, the chain cutter bit 220 is pivoted about the chain shaft 222 to a predetermined chain cutter bit angle with relation to the longitudinal axis of the FTT unit 202, as best illustrated in FIG. 32. A drilling mud or fluid is pumped through the drill string 6 into the bottom hole assembly 20. The drilling mud powers the mud motor which rotates the driver shaft 206 and driver pinion gear 210.

The driver pinion gear 210 drives and rotates the crown gear 212, which in turn rotates the shaft 214. The shaft 214 then rotates the intermediate gear 216, which is engaged with the chain driving gear 224. The chain driving gear 224, being driven and rotated by the intermediate gear 216, then rotates the chain shaft 222, which in turn the driven sprocket 226. The driven sprocket 226 then drives and rotates the endless cutter chain 232.

It can be appreciated that the FTT unit 202 can further include controllable ports or valves to deliver the mud exterior of the FTT unit 202. It can further be appreciated that multiple cutter chains can be used to adjust the width of the channel to be cut into the formation, and that different lengths of the cutter chain can be used to adjust the depth of the channel.

In use, it can now be understood that the subsurface formation cutter 10, while in the retracted configuration, is advanced into the wellbore to a predetermined position in the formation requiring additional formation cutting by way of the drill string connected to the subsurface formation cutter 10. The position in the formation may be determined and transmitted by a measurement while drilling (MWD) tool to an operator or control system. The drill string can then be rotated to position the cutter bit in any required direction being 0° to 360° around the circumference of the wellbore.

At a surface above the formation, drilling mud or fluid is pumped and circulated down the drill string to operate the mud motor. The mud motor rotates the drive system of the FTT unit, which in turn drives and rotates the cutter bit thereby providing a cutting operation to the formation. The drilling mud is further transferred to the ram unit to operate the ram unit to force the cutter bit to the deployed configuration into the formation. The cutter bit is pivoted outwardly from the subsurface formation cutter by the pivotably connected bit brace that is driven by the ram unit.

During the deployment of the cutter bit, the rotating cutter bit cuts into the formation until the bit brace is locked into the predetermined deployed cutting position by engagement of the traveling member with the friction block. Furthermore, a portion of the drilling mud is directed to the cutting bit to remove cuttings away from the formation and into the wellbore or annulus, and to circulate it to the surface.

The channel is formed in the formation by continuous pumping of the drilling mud to sustain rotation of the cutter bit, while at the same time providing a pulling force on the drill string which in turn pulls the deployed subsurface formation cutter a predetermined distance. The pulling force forces the rotating cutter bit to contact and cut into the formation thereby creating the channel.

To stop the cutting operation, the pulling force on the drill string is stopped while the drill mud continues to be pumped so as to remove any remaining cuttings or debris from the area surrounding the subsurface formation cutter. Upon the completion of adequate drill mud circulation, the pumping of drill mud is stopped, which causes drill mud to be dumped out of the mud motor and out the ram unit through the ram unit dump valve.

A pulling force on the drill string is again initiated, which pulls the deployed cutter bit against the channel wall thereby pushing the cutter bit and bit brace into the retracted configuration. The pushing of the bit brace into the retracted position creates a pushing force on the piston in the ram unit, which pushes remaining drilling mud out of the ram unit and out the dump valve. Continuous pulling of the drill string will pull the subsurface formation cutter through wellbore to another position in the formation requiring direction cutting, or out the wellbore.

It can be appreciated that after the channel has been cut into the formation, the wellbore may be left as an open wellbore or be completed with an appropriate liner or cementing for future operations.

While embodiments of the subsurface formation cutter have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, composites or alloys may be used instead of the above described. And although directional cutting into subterranean formations have been described, it should be appreciated that the subsurface formation cutter herein described is also suitable for any directional cutting into the earth.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A subsurface formation cutter for directional cutting into a subterranean formation, said subsurface formation cutter comprising:

a transmission unit having a housing, and a driver shaft operatively coupled to a motor of a bottom hole assembly;

a cutter bit having a connector member, a cutter body rotatably coupled to said connector member, and a bit shaft connected to said cutter body, said bit shaft being operatively coupled to said driver shaft of said transmission unit to rotate said cutter body, said cutter bit being pivotably associated with said transmission unit;

a bit brace having a first end pivotably connectable to said connector member of said cutter bit, and a second end;

a ram unit having a moveable ram shaft connected to a traveling member, said traveling member being pivotably connectable to said second end of said bit brace; and a connection member attached to said transmission unit and said ram unit, said connection member being configured to receive and guide said traveling member to travel in a direction parallel with a longitudinal axis of said subsurface formation cutter;

wherein said cutter body further comprises at least one bit passage defined along at least a portion of a longitudinal axis of said cutter body, and at least one outlet port defined through said cutter body and in fluid communication with said bit passage, said bit passage being in fluid communication with said transmission unit.

2. The subsurface formation cutter as claimed in claim 1, wherein said transmission unit further comprises at least one driver gear attached to said driver shaft of said transmission unit.

3. The subsurface formation cutter as claimed in claim 2, wherein said cutter bit further comprises at least one bit gear attached to said bit shaft of said cutter bit, said bit gear is operatively coupled to said driver gear of said transmission unit.

4. The subsurface formation cutter as claimed in claim 3, wherein said transmission unit further comprises at least one intermediate gear operatively coupled between said driver gear and said bit gear.

5. The subsurface formation cutter as claimed in claim 3, where said transmission unit further comprises a cover configured to rotatably receive said bit shaft of said cutter bit therethrough, and a slot defined through a portion of said housing, said slot is configured to receive said bit shaft of said cutter bit therethrough.

6. The subsurface formation cutter as claimed in claim 5, where said cover is configured to support said cutter bit at a predetermined angle in relation to a longitudinal axis of said transmission unit.

7. The subsurface formation cutter as claimed in claim 3, wherein said cutter bit further comprises a flexible shaft attached between said bit shaft and said cutter body.

8. The subsurface formation cutter as claimed in claim 3, wherein said bit shaft is a first bit shaft connected to said bit gear, and a second bit shaft connected to said cutter body, said first and second bit shafts are operatively coupled to each other by a universal joint.

9. The subsurface formation cutter as claimed in claim 3, wherein said bit shaft has a configuration capable of transmitting fluid from said transmission to said cutter bit.

10. The subsurface formation cutter as claimed in claim 9, wherein said bit gear has a bit gear passage defined therethrough and in fluid communication with said bit passage and with an interior of said transmission unit, and said bit shaft has a bit shaft passage defined therethrough and in fluid communication with said interior of said transmission unit.

11. The subsurface formation cutter as claimed in claim 1, where said connection member further comprising a friction block configured to removably retain said traveling member at a predetermined location along said connection member.

12. The subsurface formation cutter as claimed in claim 1 further comprising a pin associated with said traveling member and received in at least one slot defined in a portion of said connection member.

13. The subsurface formation cutter as claimed in claim 1 further comprising a fluid line in fluid communication with said transmission unit and said ram unit, said fluid line is configured to provide a fluid from said transmission unit to said ram unit to move said ram shaft.

14. The subsurface formation cutter as claimed in claim 1, wherein said driver shaft and said bit shaft are operatively coupled to each other by a universal joint.

15. The subsurface formation cutter as claimed in claim 1 further comprising a flexible fluid line in fluid communication with said bit passage and said transmission unit.

16. The subsurface formation cutter as claimed in claim 15, wherein said cutter bit further comprises a connector member passage defined in a portion of said connector member, said connector member passage is in fluid communication with said bit passage and said flexible fluid line.

17. The subsurface formation cutter as claimed in claim 1, wherein said cutter body is configured to cut into the subterranean formation when said cutter bit is pivoted by said bit brace.

18. The subsurface formation cutter as claimed in claim 1, wherein said cutter bit further comprises at least one bit attached to said cutter body, said bit is selected from the group consisting of at least one spiral bit, at least one circular bit, a conical bit, and a cutter chain.

19. The subsurface formation cutter as claimed in claim 18, wherein said bit is attached in a spaced relationship to said cutter body to define a gap between said bit and said cutter body, said gap is in fluid communication with said outlet port.

20. The subsurface formation cutter as claimed in claim 18, wherein said bit further comprising at least one protrusion element extend out from said bit.

21. A subsurface formation cutter comprising:

a transmission unit having a housing, a driver shaft operatively coupled to a motor of a bottom hole assembly, and at least one driver gear;

a cutter bit having a connector member, a cutter body rotatably coupled to said connector member, a bit shaft connected to said cutter body, and a bit gear connected to said bit shaft, said bit gear being operatively coupled to said driver gear of said transmission unit to rotate said cutter body, said cutter bit being pivotably associated with said transmission unit;

a bit brace having a first end pivotably connectable to said connector member of said cutter bit, and a second end;

a ram unit having a moveable ram shaft connected to a traveling member, said traveling member being pivotably connectable to said second end of said bit brace; and a connection member attached to said transmission unit and said ram unit, said connection member having at least one slot defined in a portion of said connection member, said connection member being configured to receive and guide said traveling member to travel in a direction parallel with a longitudinal axis of said subsurface formation cutter;

wherein said cutter body further comprising at least one bit passage defined along at least a portion of a longitudinal axis of said cutter body, and at least one outlet port defined through said cutter body and in fluid communication with said bit passage, said bit passage being in fluid communication with said transmission unit.

22. The subsurface formation cutter as claimed in claim 21, where said connection member further comprising a friction block configured to removably retain said traveling member at a predetermined location along said connection member.

23. The subsurface formation cutter as claimed in claim 21 further comprising at least one pin associated with said traveling member, said pin being received in said slot of said connection member.

24. A subsurface formation cutter comprising:

a transmission unit having a housing, a driver shaft operatively coupled to a motor of a bottom hole assembly, and at least one driver gear attached to said driver shaft;

a cutter bit having a connector member, a cutter body rotatably coupled to said connector member, a first bit shaft connected to a bit gear, a second bit shaft connected to said cutter body, and a universal joint operatively coupled to said first and second bit shafts, said bit gear being operatively coupled to said driver gear of said transmission unit, said cutter bit being pivotably associated with said transmission unit;

a bit brace having a first end pivotably connectable to said connector member of said cutter bit, and a second end;

a ram unit having a moveable ram shaft connected to a traveling member, said traveling member being pivotably connectable to said second end of said bit brace; and a connection member attached to said transmission unit and said ram unit, said connection member being configured to receive and guide said traveling member to travel in a direction parallel with a longitudinal axis of said subsurface formation cutter.

25. The subsurface formation cutter as claimed in claim 24, wherein said cutter body further comprises at least one bit passage defined along at least a portion of a longitudinal axis of said cutter body, and at least one outlet port defined through said cutter body and in fluid communication with said bit passage.

26. A method of directional cutting into a subterranean formation using a formation cutter, said method comprising the steps of:

a) advancing a formation cutter into a wellbore while said formation cutter is in a retracted configuration;

b) operating a motor operatively connected to a transmission unit of said formation cutter;

c) operating a cutter bit of said formation cutter, said cutter bit having a connection member, a cutter body rotatably coupled to said connector member, and a bit shaft connected to said cutter body, said bit shaft being operatively coupled to a driver shaft of said transmission unit to rotate said cutter body;

d) transferring a fluid from said transmission unit to at least one bit passage defined along at least a portion of said longitudinal axis of said cutter body, said bit passage being in fluid communication with at least one outlet port defined through said cutter body, said bit passage being in fluid communication with said transmission unit;

e) operating a ram unit to force said cutter bit to a deployed configuration into a subterranean formation, said ram unit having a moveable ram shaft connected to a traveling member, said traveling member being pivotably connectable to a second end of a bit brace; and f) pivoting said cutter bit outwardly from said formation cutter by said ram unit, said connector member of said cutter bit being pivotably connected to a first end of said bit brace.

27. A method of directional cutting into a subterranean formation using a formation cutter, said method comprising the steps of:

a) advancing a formation cutter into a wellbore while said formation cutter is in a retracted configuration;

b) operating a motor operatively connected to a transmission unit of said formation cutter;

c) operating a cutter bit of said formation cutter, said cutter bit having a connection member, a first bit shaft connected to a bit gear, a second bit shaft connected to said cutter body, and a universal joint operatively coupling said first and second bit shafts to each other, said bit gear being operatively coupled to a driver gear of said transmission unit to rotate said cutter body;

d) operating a ram unit to force said cutter bit to a deployed configuration into a subterranean formation, said ram unit having a moveable ram shaft connected to a traveling member, said traveling member being pivotably connectable to a second end of a bit brace; and e) pivoting said cutter bit about said universal joint and outwardly from said formation cutter by said ram unit, said connector member of said cutter bit being pivotably connected to a first end of said bit brace.

* * * * *